US011680361B2

(12) United States Patent
Uchikoshi

(10) Patent No.: US 11,680,361 B2
(45) Date of Patent: Jun. 20, 2023

(54) LOWER BUCK FOR CUFF FINISHING AND SHEET MEMBER FOR THE LOWER BUCK

(71) Applicant: SANKOSHA CO., LTD., Tokyo (JP)

(72) Inventor: Yusuke Uchikoshi, Tokyo (JP)

(73) Assignee: Sankosha Co., Ltd., Tokyo (JP)

( * ) Notice: Subject to any disclaimer, the term of this patent is extended or adjusted under 35 U.S.C. 154(b) by 0 days.

(21) Appl. No.: 17/670,652

(22) Filed: Feb. 14, 2022

(65) Prior Publication Data

US 2022/0290363 A1 Sep. 15, 2022

(30) Foreign Application Priority Data

Mar. 9, 2021 (JP) ..... JP2021-37763

(51) Int. Cl.
*D06F 71/24* (2006.01)
*D06F 71/40* (2006.01)
*D06F 83/00* (2006.01)

(52) U.S. Cl.
CPC ..... *D06F 71/24* (2013.01); *D06F 71/40* (2013.01); *D06F 83/00* (2013.01)

(58) Field of Classification Search
CPC .... D06F 71/18–26; D06F 71/36; D06F 71/40; D06F 83/00; D06F 81/12; D06F 81/14
See application file for complete search history.

(56) References Cited

U.S. PATENT DOCUMENTS 1,455,108 A * 5/1923 Colclough ..... D06F 81/14 38/66
2,036,964 A * 4/1936 Galvin ..... D06F 83/00 38/66
2,046,785 A * 7/1936 Malott, Jr. ..... D06F 71/06 38/41
2,136,564 A * 11/1938 Ricketson ..... D06F 71/36 38/66
2,626,733 A * 1/1953 Maxwell ..... D06F 71/285 223/57
3,613,969 A * 10/1971 Forse ..... D06F 71/20 223/37
5,553,410 A * 9/1996 Derby ..... D06F 71/22 38/13
6,497,060 B1 * 12/2002 Bolan, Jr ..... D06F 71/22 38/21
6,722,063 B1 * 4/2004 Uchikoshi ..... D06F 71/28 223/57

* cited by examiner

*Primary Examiner* — Ismael Izaguirre
(74) *Attorney, Agent, or Firm* — Rosenberg, Klein & Lee

(57) ABSTRACT

A body part (2) has an upper surface formed into a convex curve shape, and a cushion member (3) is overlaid on the upper surface of the body part (2). The body part (2) is vertically divided to include an upper section (2*a*) and a lower section (2*b*). The cushion member (3) includes an upper cushion member (3A) and a lower cushion member (3B). The upper cushion member (3A) and the lower cushion member (3B) are covered with a cushioning sheet member (4). The sheet member (4) includes attachment means (5) for attachment to the body part (2). An attachment site (6) for the attachment means (5) is provided at the body part (2). The sheet member (4) has a back side where the upper cushion member (3A) is provided. The body part (2) is covered with a cover (11) through the sheet member (4).

6 Claims, 8 Drawing Sheets

LOWER BUCK FOR CUFF FINISHING AND SHEET MEMBER FOR THE LOWER BUCK

BACKGROUND OF THE INVENTION

1. Field of the Invention

The present invention relates to a lower buck for cuff finishing, more specifically, to a lower buck for cuff finishing and a sheet member for the lower buck.

2. Description of the Related Art

A conventional lower buck of this type includes a body part with an upper surface to receive a pressing pressure formed into a convex curve shape. In the conventional item, a cushion member for easing the pressing pressure is overlaid on the upper surface of the body part (see Patent Literature 1, U.S. Pat. No. 6,497,060, for example).

In this case, the cushion member is prone to get dirty with laundry starch applied to a cuff. In response to this, the lower buck of this type is generally covered with a cover attached to the body part.

The cushioning properties of the cushion member are damaged as the number of presses increases. This makes it necessary to change the cushion member on a regular basis.

For implementation of this change, the cover is first removed from the body part, then the cushion member is changed, and the cover is thereafter attached again.

In some cases, in the conventional lower buck of this type, the body part is vertically divided to include an upper section and a lower section (see Patent Literature 2, Japanese Patent No. 3799576, for example).

In the lower buck of this type, the cushion member for easing a pressing pressure includes an upper cushion member covering an upper surface of the upper section of the body part and a lower cushion member covering an upper surface of the lower section of the body part.

In this conventional case, the cushion member is merely placed on the upper surface of the body part. Hence, using the conventional item may cause a situation where the cushion member gets out of position or drops during change of the cushion member. In particular, the cushion member covering the upper surface of the upper section of the body part is easily touched by a hand during attachment or removal of the cover to make it likely that the cushion member will easily be misaligned or will easily drop accordingly.

Thus, the conventional case causes a problem that changing the cushion member of the above-described type requires skillful and burdensome operation.

In the case of a lower buck with a vertically-divided body part, a line at a site of the division easily causes a crease in a cuff during press.

Hence, using the conventional item causes a problem of failing to finish a cuff satisfactorily.

SUMMARY OF THE INVENTION

The present invention has been suggested in view of the above-described problems occurring in the conventional item.

Thus, a technical problem to be solved by the present invention is to provide a lower buck for cuff finishing with a vertically-divided body part and a sheet member for the lower buck that are formed in such a manner as to allow operation of changing a cushion member covering an upper section to be performed simply and speedily, to prevent influence on finishing of a cuff by a line at a site of the division, and to finish the cuff satisfactorily.

To solve the above-described problem, the present invention employs technical means as follows.

Specifically, as shown in FIG. 1 and the like, the present invention is intended for a lower buck 1 for cuff finishing comprising a body part 2 with an upper surface to receive a pressing pressure formed into a convex curve shape, and a cushion member 3 for easing the pressing pressure overlaid on the upper surface of the body part 2. The body part 2 is vertically divided to include an upper section 2*a* and a lower section 2*b*. The cushion member 3 includes an upper cushion member 3A covering an upper surface of the upper section 2*a* and a lower cushion member 3B covering an upper surface of the lower section 2*b*. The upper cushion member 3A and the lower cushion member 3B are covered with a cushioning sheet member 4. The sheet member 4 includes attachment means 5 for attachment to the body part 2. An attachment site 6 for the attachment means 5 is provided at the body part 2. The sheet member 4 has a back side where the upper cushion member 3A is provided. The body part 2 is covered with a cover 11 through the sheet member 4.

As shown in FIG. 2, a cuff finishing machine generally includes the lower buck 1 on each of the right side and the left side in order to finish cuffs 13*a* for both sleeves of a shirt 13 simultaneously. Thus, upper bucks 14 are arranged above the lower bucks 1 so as to conform to the lower bucks 1.

As shown in FIG. 4 and the like, in the present invention, it is preferable that a band strip 8 is stretched between front and back side edges of the sheet member 4, and the upper cushion member 3A is clamped to the sheet member 4 using the band strip 8.

This is because it allows the upper cushion member 3A to be changed simply and speedily.

In this case, in the present invention, as shown in FIGS. 1, 5, 7, etc., it is preferable that the sheet member 4 is folded at each of right and left sides of the sheet member 4 corresponding to the lower cushion member 3B to be formed into a bag-like section 4*a*, a buffer member 9 to be overlaid on the lower cushion member 3B is stored in the bag-like section 4*a*, a second buffer member 10 being the same at least in size as the upper cushion member 3A is provided between the upper cushion member 3A and a back surface of the sheet member 4, and the second buffer member 10 has the same thickness and is made of the same material as the buffer member 9 stored in the bag-like section 4*a*.

This is because it allows the buffer member 9 to be changed simply by taking the buffer member 9 into and out of the bag-like section 4*a*. Furthermore, compared to a case where a single buffer member is provided entirely to the sheet member 4, the buffer member 9 and the second buffer member 10 can be changed efficiently in response to their states of degradation.

The sheet member 4 to be used for the lower buck 1 of the present invention may be formed into a shape such as that shown in FIG. 1 and the like.

Specifically, in the present invention, the sheet member 4 is a cushioning sheet member 4 covering the upper cushion member 3A and the lower cushion member 3B, the sheet member 4 comprises the attachment means 5 for attachment to the body part 2, and the sheet member 4 has the back side where the upper cushion member 3A is provided.

In this case, it is preferable that, in the sheet member 4 of the present invention, the upper cushion member 3A is clamped using the band strip 8 stretched between the front and back side edges of the sheet member 4.

It is further preferable that, in the sheet member 4 of the present invention, the sheet member 4 is folded at each of right and left sides of the sheet member 4 corresponding to the lower cushion member 3B to be formed into the bag-like section 4*a*, the buffer member 9 to be overlaid on the lower cushion member 3B is stored in the bag-like section 4*a*, the second buffer member 10 being the same at least in size as the upper cushion member 3A is provided between the upper cushion member 3A and the back surface of the sheet member 4, and the second buffer member 10 has the same thickness and is made of the same material as the buffer member 9 stored in the bag-like section 4*a*.

As described above, in the present invention, the upper cushion member and the lower cushion member are covered with the cushioning sheet member, the sheet member includes the attachment means for attachment to the body part, the attachment site for the attachment means is provided at the body part, the sheet member has the back side where the upper cushion member is provided, and the body part is covered with the cover through the sheet member.

Thus, in the present invention, the upper cushion member can be changed while the sheet member is fixed to the upper surface of the body part using the attachment means and the upper cushion member is fixed to the upper surface of the body part.

As a result, in the present invention, unintentional occurrence such as drop of the upper cushion member is prevented during attachment and removal of the cover. This makes it possible to perform operation of changing the upper cushion member simply and speedily without requiring skill.

In the present invention, the upper surface of the body part is covered with the sheet member.

Thus, in the present invention, it becomes possible to prevent the occurrence of a crease in a cuff during press resulting from a line at a site of the division between the upper section and the lower section. For this reason, it becomes possible to finish the cuff satisfactorily.

DETAILED DESCRIPTION OF THE INVENTION

A preferred embodiment of the present invention will be described next on the basis of the accompanying drawings.

Figure 1:
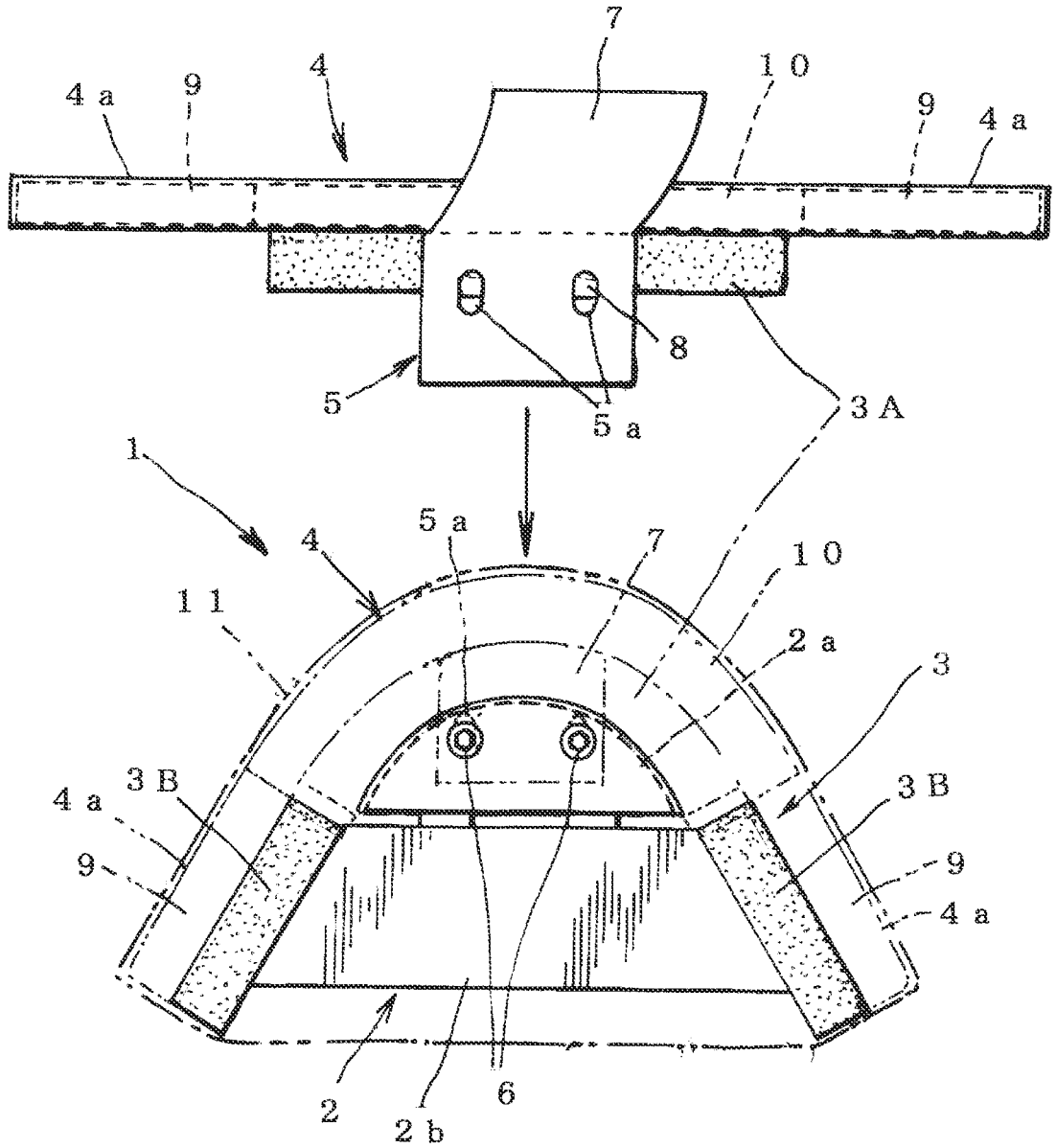
FIG. 1 is a principal part front view showing a preferred embodiment of the present invention.

As shown in FIG. 1 and the like, a lower buck 1 of the present invention includes a body part 2 with an upper surface to receive a pressing pressure formed into a convex curve shape.

In the present invention, a cushion member 3 for easing the pressing pressure is overlaid on the upper surface of the body part 2. The cushion member 3 is formed into a plate-like shape using a resin material such as silicon sponge or silicon rubber, for example. A surface of the cushion member 3 contacting the upper surface of the body part 2 is formed into an uneven shape and is provided with a large number of neatly arranged thin holes 3*a* penetrating the cushion member 3 in a thickness direction.

The body part 2 is vertically divided to include an upper section 2*a* and a lower section 2*b*. The cushion member 3 includes an upper cushion member 3A covering an upper surface of the upper section 2*a* and a lower cushion member 3B covering an upper surface of the lower section 2*b*.

In the present invention, the upper cushion member 3A and the lower cushion member 3B are covered with a cushioning sheet member 4. The sheet member 4 is made of air-permeable cloth, for example, and includes attachment means 5 for attachment to the body part 2.

Figure 4:
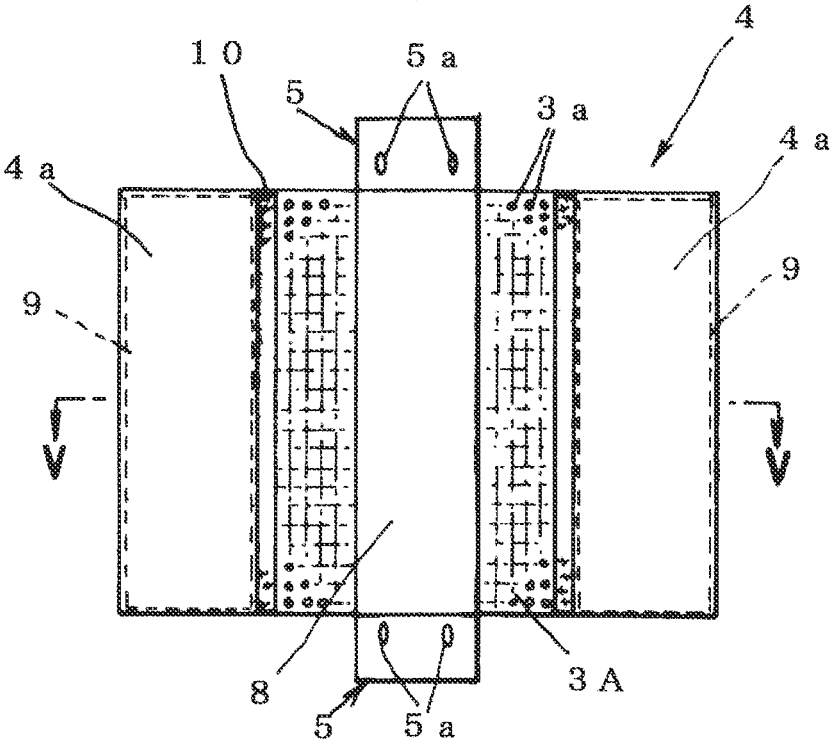
FIG. 4 is a back view of the sheet member.
Figure 5:
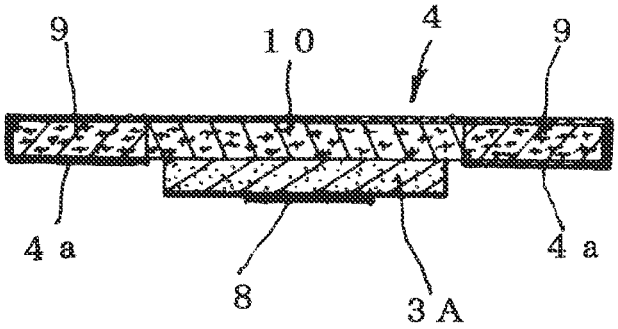
FIG. 5 is a sectional view taken along a line V-V in FIG. 4.

The attachment means 5 of the present embodiment is tongue-shaped cloth. This cloth is provided with holes 5*a* for fitting to attachment sites 6 of the body part 2. As shown in FIG. 4 and the like, the cloth as the attachment means 5 is sewed on the sheet member 4 at the front and back of a center position of the sheet member 4 as viewed in a right-left direction.

Figure 12:
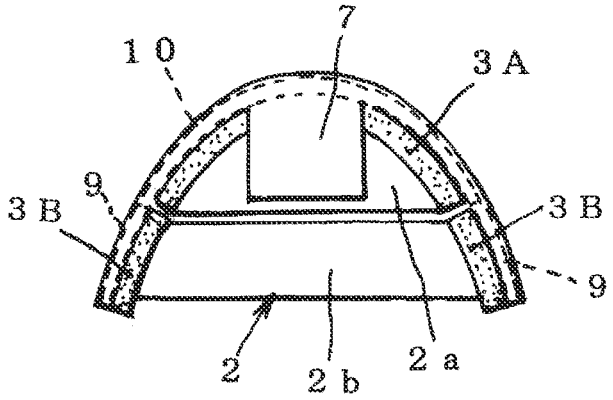

A sign 7 (see FIGS. 1, 12 and the like) is a cloth strip covering the attachment sites 6. The cloth strip 7 is arranged external to the cloth as the attachment means 5 and is sewed together with the cloth on the sheet member 4.

Figure 9:
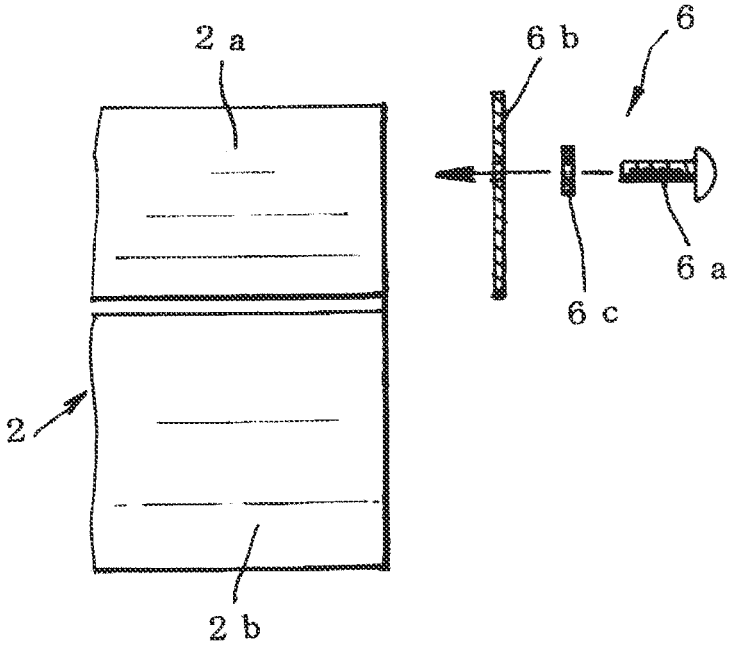
FIG. 9 is a principal part exploded side view of the lower buck.

As shown in FIG. 9, the attachment sites 6 of the present embodiment are each formed like a projection using a screw 6*a*. The screw 6*a* is attached through a spacer 6*c* to a metal plate 6*b* fixed to a side surface of the upper section 2*a* of the body part 2. The attachment sites 6 are provided on each of front and back side surfaces of the upper section 2*a* of the body part 2. In the present embodiment, the screws 6*a* as the attachment sites 6 are provided one by one at each of right and left positions on each of these side surfaces. Thus, in response to these attachment sites 6, the holes 5*a* are provided one by one at each of right and left positions of the tongue-shaped cloth as the attachment means 5.

Figure 6:
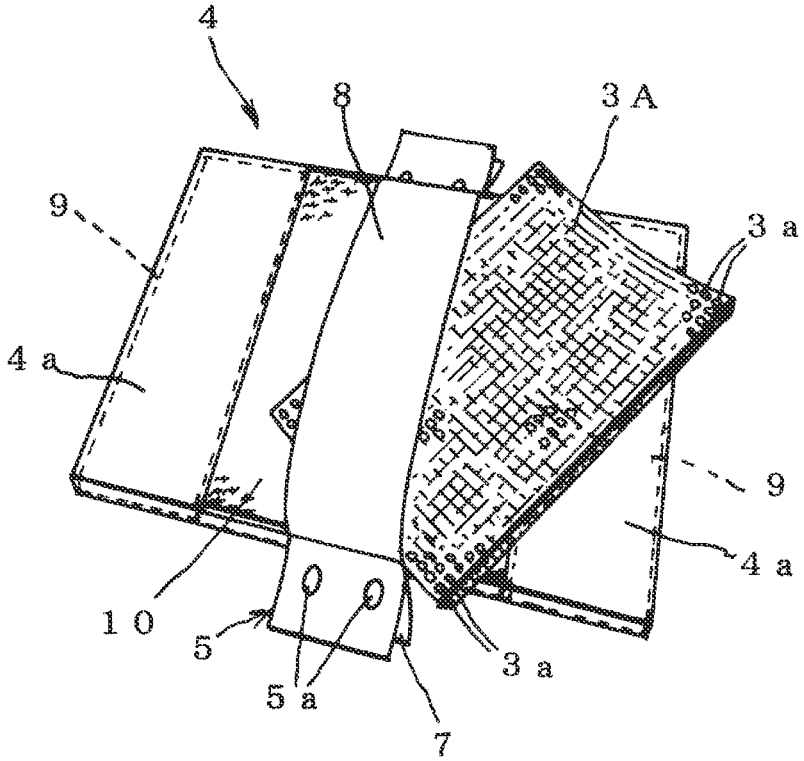
FIG. 6 is a perspective view for explaining exemplary attachment of an upper cushion member.
Figure 7:
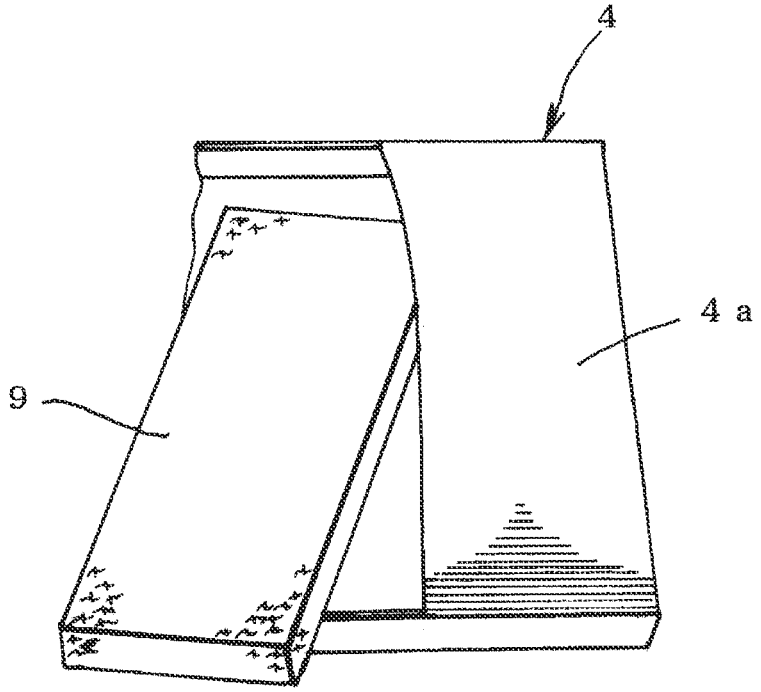
FIG. 7 is a principal part perspective view for explaining exemplary attachment of a buffer member.
Figure 8:
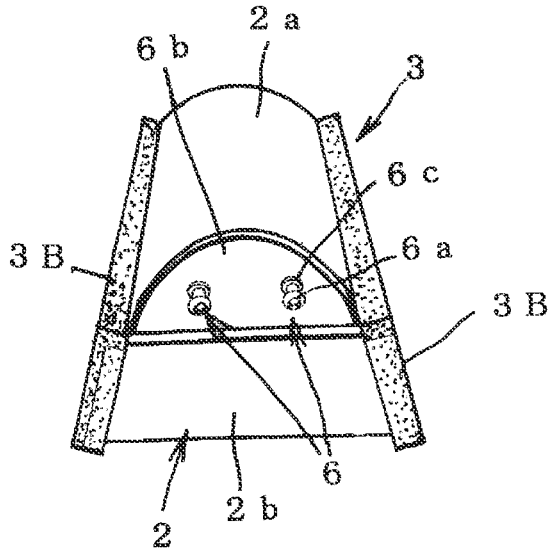
FIG. 8 is a principal part perspective view of a lower buck.

The sheet member 4 has a back side where the upper cushion member 3A is provided. A sign 8 is a band strip for clamping the upper cushion member 3A. The band strip 8 is stretched between front and back side edges of the sheet member 4 and sewed on the sheet member 4. As shown in FIG. 6 and the like, the upper cushion member 3A is inserted between the band strip 8 and the back surface of the sheet member 4 and is clamped to the sheet member 4 using the band strip 8.

As shown in FIG. 1 and the like, the sheet member 4 is folded at each of its right and left sides corresponding to the lower cushion member 3B to be formed into a bag-like section 4*a*. In the sheet member 4, a buffer member 9 to be overlaid on the lower cushion member 3B is stored in the bag-like section 4*a*. The buffer member 9 of the present embodiment is made of flannel.

Figure 3:
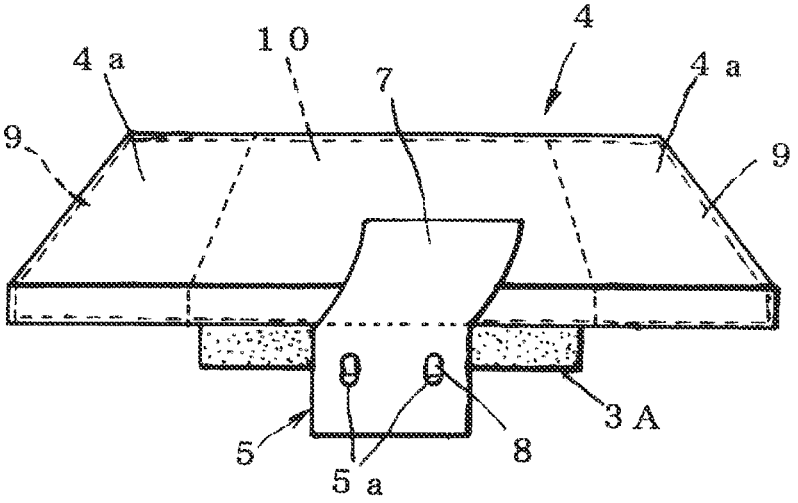
FIG. 3 is a perspective view of a sheet member.

In the present embodiment, the upper cushion member 3A and the lower cushion member 3B are made of the same material and formed into the same thickness. A sign 10 (see FIG. 3 and the like) is a second buffer member provided between the back surface of the sheet member 4 and the upper cushion member 3A. Like the buffer member 9, the second buffer member 10 is made of flannel and is formed into a sheet-like shape, and has the same thickness as the buffer member 9. The second buffer member 10 of the present embodiment is formed into a slightly larger size than the upper cushion member 3A.

As shown in FIG. 1 and the like, the upper cushion member 3A is overlaid on the second buffer member 10 and is clamped together with the second buffer member 10 to the sheet member 4 using the band strip 8.

Figure 13:
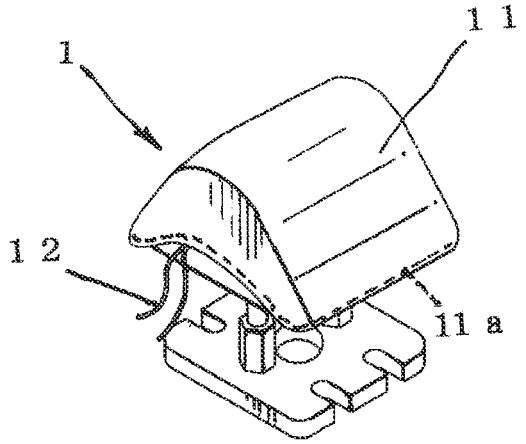
FIG. 13 is a principal part perspective view showing a state coated with a cover.

The lower buck 1 of the present invention is coated with the sheet member 4 placed on the upper surface of the body part 2 and is covered with a cover 11 through the sheet member 4 (see FIG. 13 and the like). The cover 11 is made of air-permeable cloth and is folded at its periphery to be formed into a tubular eyelet section 11*a*. The cover 11 is configured to be mountable to the body part 2 by passing a string 12 through the eyelet section 11*a* and tying both ends of the string 12. The cover 11 is preferably attached to the body part 2 under tension so as not to cause a crease in a surface of the cover 11.

The following describes the operation of mounting the sheet member 4.

Figure 10:
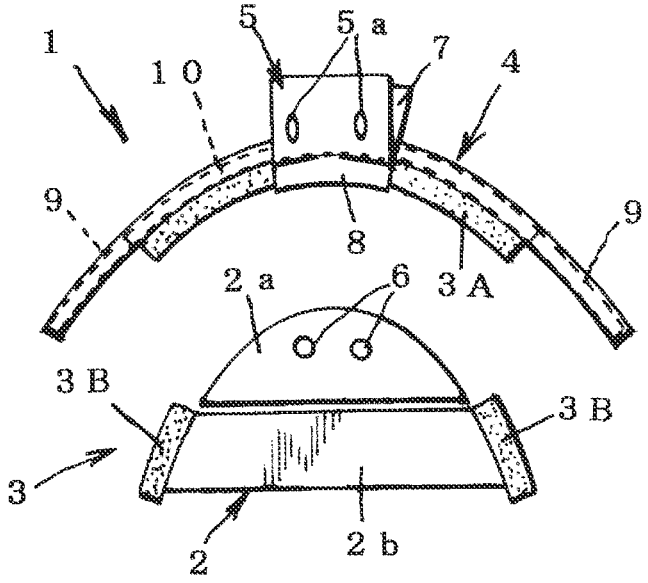
FIGS. 10, 11, and 12 are front views each explaining operation of attaching the sheet member.

First, as shown in FIGS. 1, 10 and the like, an operator mounts the sheet member 4 by overlaying the sheet member 4 on the upper surface of the body part 2. More specifically, with the lower cushion member 3B mounted on the lower section 2*b* of the body part 2, the operator places the upper cushion member 3A on the upper section 2*a* of the body part 2 and puts the sheet member 4 over the upper cushion member 3A.

Figure 11:
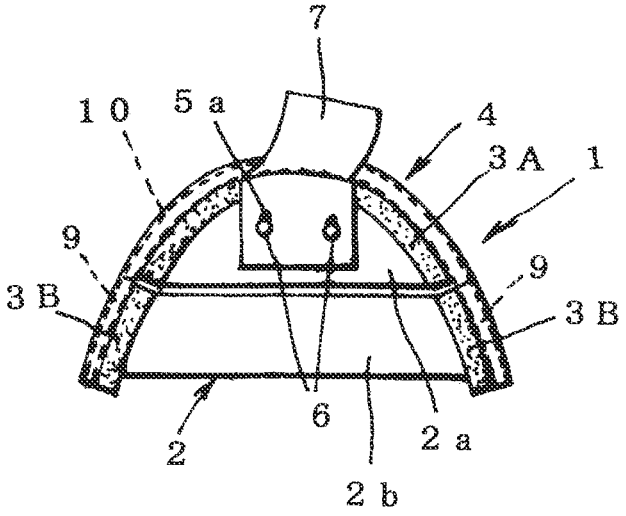

Next, the operator pulls the cloth as the attachment means 5 and then fits the holes 5*a* to the attachment sites 6 as shown in FIG. 11. The operator performs this operation on each of the front and back of the body part 2. Then, the operator hangs the cloth strip 7 and covers the attachment sites 6 with the cloth strip 7 (see FIG. 12).

Figure 2:
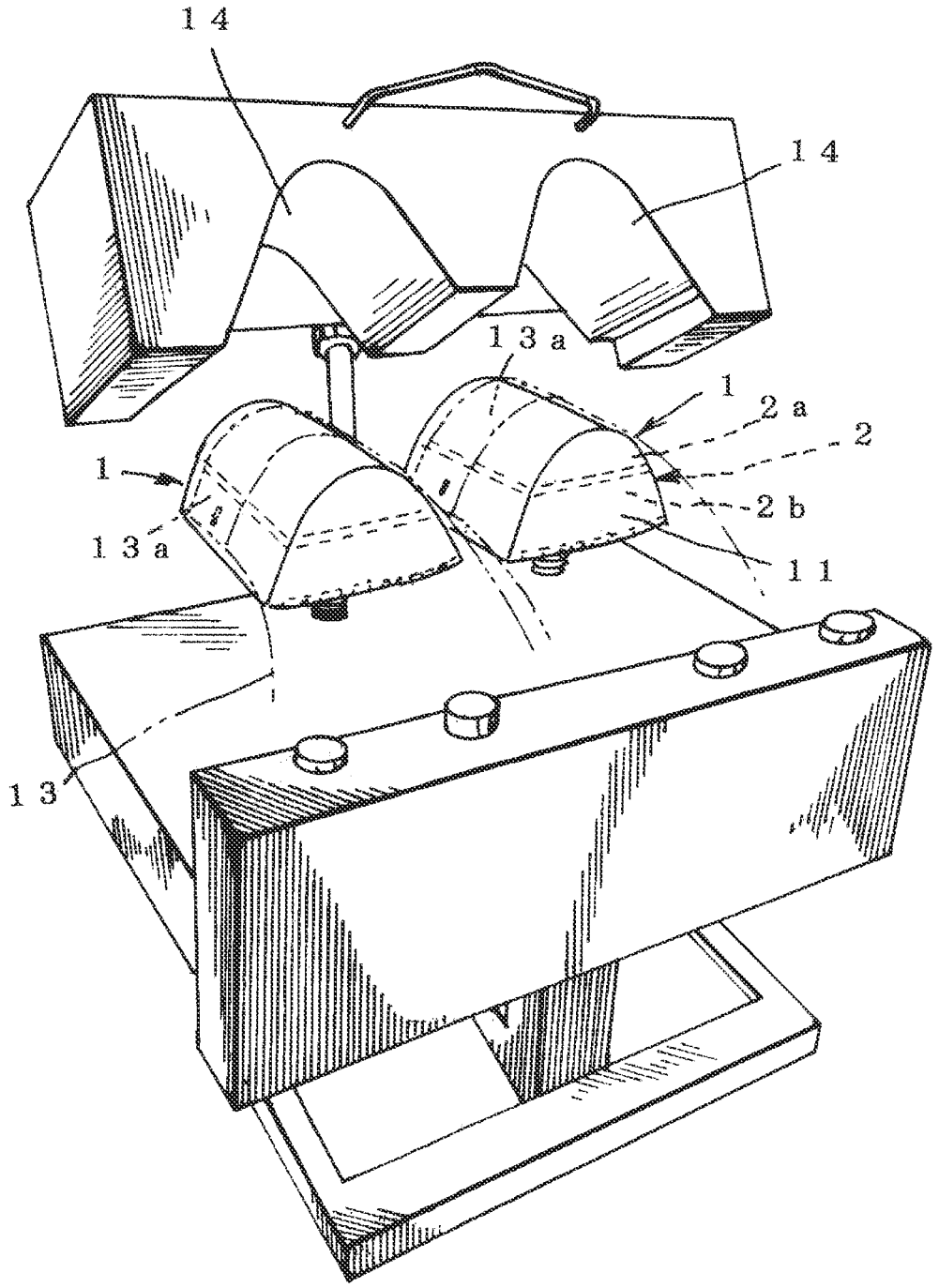
FIG. 2 is a perspective view of a cuff finishing machine.
Figure 14:
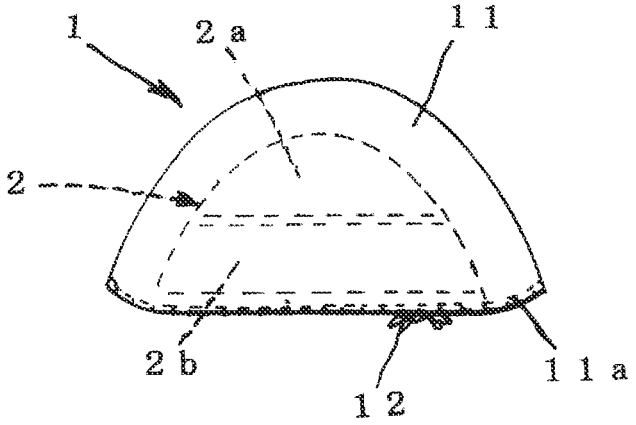
FIG. 14 is a principal part front view showing the state coated with the cover.

Next, the operator puts the cover 11 over the sheet member 4 and covers the body part 2 with the cover 11 (see FIG. 13). Then, the operator fastens the cover 11 to the body part 2 securely using the string 12 (see FIG. 14). As shown in FIG. 2, the operator thereafter places cuffs 13*a* of a shirt 13 over the lower buck 1 and moves down an upper buck 14, thereby press-finishing the cuffs 13*a*.

As described above, the present invention makes it possible to mount the cover 11 on the body part 2 while the sheet member 4 is fixed to the body part 2 using the attachment means 5. By doing so, even if the upper cushion member 3A is unintentionally touched during attachment or removal of the cover 11, it is still possible to prevent misalignment or drop of the upper cushion member 3A.

In the present embodiment, the upper cushion member 3A is clamped to the sheet member 4 using the band strip 8. This allows the upper cushion member 3A to be attached to and removed from the sheet member 4 simply and speedily, thereby facilitating operation of changing the upper cushion member 3A.

While the sheet member 4 of the foregoing example includes the buffer member 9 and the second buffer member 10 as described above, the present invention is not limited to this. Specifically, in the present invention, the sheet member 4 may be formed of a single cushion material, for example.

What is claimed is:

1. A lower buck for cuff finishing comprising a body part with an upper surface to receive a pressing pressure formed into a convex curve shape, and a cushion member for easing the pressing pressure overlaid on the upper surface of the body part, the body part being vertically divided to include an upper section and a lower section, the cushion member including an upper cushion member covering an upper surface of the upper section and a lower cushion member covering an upper surface of the lower section, wherein the upper cushion member and the lower cushion member are covered with a cushioning sheet member, the sheet member includes attachment means for attachment to the body part, an attachment site for the attachment means is provided at the body part, the sheet member has a back side where the upper cushion member is provided, the body part is covered with a cover through the sheet member, the sheet member is folded at each of right and left sides of the sheet member corresponding to the lower cushion member to be formed into a bag-like section, a buffer member to be overlaid on the lower cushion member is stored in the bag-like section, a second buffer member being the same at least in size as the upper cushion member is provided between the upper cushion member and a back surface of the sheet member, and the second buffer member has the same thickness and is made of the same material as the buffer member stored in the bag-like section.

2. The lower buck for cuff finishing according to claim 1, wherein a band strip is stretched between front and back side edges of the sheet member, and the upper cushion member is clamped to the sheet member using the band strip.

3. A sheet member to be used for the lower buck for cuff finishing according to claim 1, wherein the sheet member is a cushioning sheet member covering an upper cushion member and a lower cushion member, the sheet member comprises attachment means for attachment to a body part, and the sheet member has a back side where the upper cushion member is provided.

4. The sheet member according to claim 3 to be used for the lower buck for cuff finishing, wherein the upper cushion member is clamped using a band strip stretched between front and back side edges of the sheet member.

5. A lower buck for cuff finishing comprising a body part with an upper surface to receive a pressing pressure formed into a convex curve shape, and a cushion member for easing the pressing pressure overlaid on the upper surface of the body part, the body part being vertically divided to include an upper section and a lower section, the cushion member including an upper cushion member covering an upper surface of the upper section and a lower cushion member covering an upper surface of the lower section, wherein the upper cushion member and the lower cushion member are covered with a cushioning sheet member and a band strip is stretched between front and back side edges of the sheet member, the upper cushion member is clamped to the sheet member using the band strip, the sheet member includes attachment means for attachment to the body part, an attachment site for the attachment means is provided at the body part, the sheet member has a back side where the upper cushion member is provided, the body part is covered with a cover through the sheet member, the sheet member is folded at each of right and left sides of the sheet member corresponding to the lower cushion member to be formed into a bag-like section, a buffer member to be overlaid on the lower cushion member is stored in the bag-like section, a second buffer member being the same at least in size as the upper cushion member is provided between the upper cushion member and a back surface of the sheet member, and the second buffer member has the same thickness and is made of the same material as the buffer member stored in the bag-like section.

6. A lower buck for cuff finishing comprising a body part with an upper surface to receive a pressing pressure formed into a convex curve shape, and a cushion member for easing the pressing pressure overlaid on the upper surface of the body part, the body part being vertically divided to include an upper section and a lower section, the cushion member including an upper cushion member covering an upper surface of the upper section and a lower cushion member covering an upper surface of the lower section, wherein the upper cushion member and the lower cushion member are covered with a cushioning sheet member, the sheet member includes attachment means for attachment to the body part, an attachment site for the attachment means is provided at the body part, the sheet member has a back side where the upper cushion member is provided, the body part is covered with a cover through the sheet member, the sheet member is a cushioning sheet member covering an upper cushion member and a lower cushion member, the sheet member comprises attachment means for attachment to a body part, the sheet member has a back side where the upper cushion member is provided, and the upper cushion member is clamped using a band strip stretched between front and back side edges of the sheet member.

* * * * *